US011303031B2

(12) United States Patent
Hamabe

(10) Patent No.: US 11,303,031 B2
(45) Date of Patent: Apr. 12, 2022

(54) ANTENNA DEVICE AND ONE SET OF ANTENNA DEVICES

(71) Applicant: Panasonic Intellectual Property Management Co., Ltd., Osaka (JP)

(72) Inventor: Taichi Hamabe, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 16 days.

(21) Appl. No.: 16/927,272

(22) Filed: Jul. 13, 2020

(65) Prior Publication Data

US 2021/0021045 A1 Jan. 21, 2021

(30) Foreign Application Priority Data

Jul. 18, 2019 (JP) ..... JP2019-132921

(51) Int. Cl.
*H01Q 9/16* (2006.01)
*H01Q 1/48* (2006.01)
*H01Q 19/09* (2006.01)

(52) U.S. Cl.
CPC ..... *H01Q 9/16* (2013.01); *H01Q 1/48* (2013.01); *H01Q 19/09* (2013.01)

(58) Field of Classification Search
CPC ..... H01Q 9/16; H01Q 19/09; H01Q 1/48
See application file for complete search history.

(56) References Cited

U.S. PATENT DOCUMENTS

2003/0197658 A1* 10/2003 Lilly ..... H01Q 15/008 343/909
2020/0112088 A1 4/2020 Hamabe

FOREIGN PATENT DOCUMENTS

WO WO-2017038045 A1 * 3/2017 ..... H01Q 9/065
WO 2019/003830 1/2019

* cited by examiner

*Primary Examiner* — Ricardo I Magallanes
(74) *Attorney, Agent, or Firm* — Wenderoth, Lind & Ponack, L.L.P.

(57) ABSTRACT

An antenna device including: a ground conductor having one end and another end in a longitudinal direction; a feeding antenna conductor disposed close to the other end; a non-feeding antenna conductor disposed close to the one end; an artificial magnetic conductor that is layered between the feeding and the non-feeding antenna conductors, and the ground conductor, and that is disposed away from each of the feeding and non-feeding antenna conductors, and the ground conductor; and at least one via conductor that is disposed between the one end of the ground conductor and the non-feeding antenna conductor in the longitudinal direction, and that electrically connects the ground conductor and the artificial magnetic conductor, wherein in the longitudinal direction, a length from the one end of the ground conductor to the non-feeding antenna conductor is shorter than a length from the other end of the ground conductor to the feeding antenna conductor.

6 Claims, 6 Drawing Sheets

ANTENNA DEVICE AND ONE SET OF ANTENNA DEVICES

BACKGROUND

1. Technical Field

The present disclosure relates to an antenna device.

2. Description of the Related Art

Patent Literature (PTL) 1 discloses an antenna device including: two antenna conductors; at least one ground conductor; and an artificial magnetic conductor that is layered between the antenna conductors and the at least one ground conductor, and is disposed away from the antenna conductors and the at least one ground conductor. This antenna device includes a cut portion formed by cutting a portion from a position substantially facing a leading-end-side end opposite to a feeding-side end of one of the two antenna conductors to a leading end of at least one of the artificial magnetic conductor and the at least one ground conductor.

PTL 1 is International Publication No. WO 2019/003830.

SUMMARY

The present disclosure provides an antenna device that achieves both miniaturization as an antenna device and stabilization of frequency characteristics of a fundamental wave at a desired operation frequency.

The present disclosure provides an antenna device including: a ground conductor having one end and another end opposite to the one end in a longitudinal direction; a feeding antenna conductor disposed close to the other end; a non-feeding antenna conductor disposed close to the one end; an artificial magnetic conductor that is layered between the feeding antenna conductor as well as the non-feeding antenna conductor, and the ground conductor, and that is disposed away from each of the feeding antenna conductor, the non-feeding antenna conductor, and the ground conductor; and at least one via conductor that is disposed between the one end of the ground conductor and the non-feeding antenna conductor in the longitudinal direction, and that electrically connects the ground conductor and the artificial magnetic conductor, wherein in the longitudinal direction, a length from the one end of the ground conductor to the non-feeding antenna conductor is shorter than a length from the other end of the ground conductor to the feeding antenna conductor.

According to the present disclosure, both miniaturization as an antenna device and stabilization of frequency characteristics of a fundamental wave at a desired operation frequency can be achieved.

DETAILED DESCRIPTION (Background to an Exemplary Embodiment According to the Present Disclosure)

As disclosed in PTL 1, when a portion from a position substantially facing a leading-end-side end opposite to a feeding-side end of a non-feeding antenna conductor to a leading end of at least one of an artificial magnetic conductor and a ground conductor is cut out, unnecessary resonance is likely to occur in an antenna device depending on a cutting ratio of the portion. This causes a problem in that performance of the antenna device (e.g., radio wave radiation characteristics in a desired operation frequency band) is not stable.

Hereinafter, an exemplary embodiment specifically disclosing an antenna device according to the present disclosure will be described in detail with reference to the drawings as appropriate. However, an unnecessarily detailed description may be omitted. For example, a detailed description of a well-known item or a duplicated description of substantially the same configuration may be omitted. This is to prevent the following description from being unnecessarily redundant to facilitate understanding of those skilled in the art. The attached drawings and the following description are provided for those skilled in the art to fully understand the present disclosure, and are not intended to limit the subject matter described in the scope of claims.

First Exemplary Embodiment

In view of the above-described background, a first exemplary embodiment shows an example of an antenna device that achieves both miniaturization as an antenna device and stabilization of frequency characteristics of a fundamental wave at a desired operation frequency. Specifically, the antenna device according to the first exemplary embodiment is mounted on, for example, a seat monitor installed on the back of a backrest of an economy class seat as an electronic device mounted on an aircraft. The antenna device radiates a radio wave in a high frequency band of, for example, 2.4 GHz to 2.5 GHz from a front face (e.g., a monitor screen) of the seat monitor toward a front direction of a rear seat. Here, the high frequency band of 2.4 GHz to 2.5 GHz is an operation frequency band used in Bluetooth (registered trademark), and will be described as a frequency band of a fundamental wave in the first exemplary embodiment.

Figure 1:
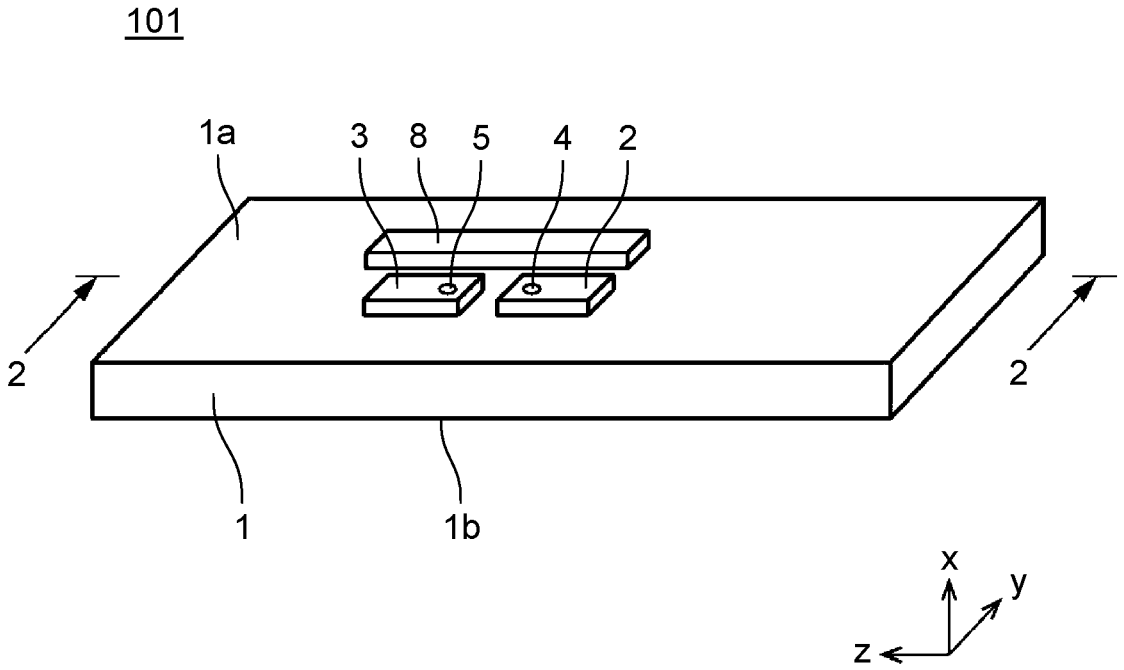
FIG. 1 is a perspective view illustrating an outer appearance of an antenna device according to a first exemplary embodiment.
Figure 2:
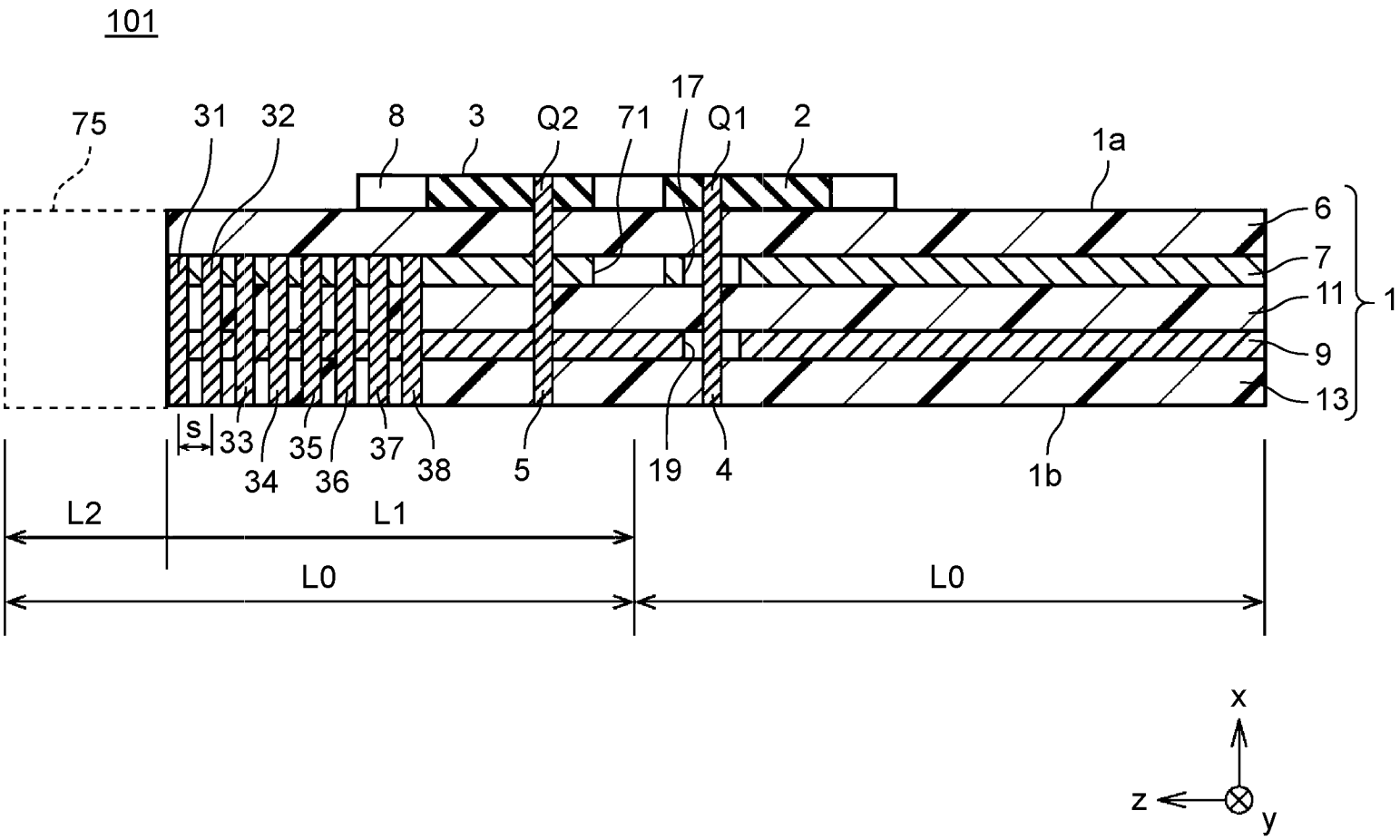
FIG. 2 is a sectional view illustrating an internal structure of the antenna device taken along line 2-2 of FIG. 1.

FIG. 1 is a perspective view illustrating an outer appearance of antenna device 101 according to the first exemplary embodiment. FIG. 2 is a sectional view illustrating an internal structure of antenna device 101 taken along line 2-2 of FIG. 1.

As illustrated in FIG. 1, antenna device 101 is formed on a printed wiring board made of a layered board having a plurality of layers, and constitutes, for example, a dipole antenna. The dipole antenna is formed, for example, by etching metal foil on a front surface of the printed wiring board. The plurality of layers is made of, for example, copper foil or glass epoxy.

Antenna device 101 includes printed wiring board 1, antenna conductor 2 that is a strip conductor as an example of a feeding antenna conductor, antenna conductor 3 that is a strip conductor as an example of a non-feeding antenna conductor, and parasitic conductor 8.

Here, xyz coordinate axes of FIGS. 1 and 2 include a z-axis in a direction indicating a longitudinal direction of each of antenna device 101 and antenna conductors 2, 3. A direction of a y-axis indicates a width direction of each of antenna device 101 and antenna conductors 2, 3, and is orthogonal to a direction of a z-axis. A direction of an x-axis indicates a thickness direction of antenna device 101 and is orthogonal to a yz plane.

Antenna conductor 2 and antenna conductor 3 are connected to via conductor 4 (feeding via conductor) and via conductor 5 (ground via conductor) of printed wiring board 1, respectively. Via conductor 4 is formed using, for example, copper foil with conductivity, and constitutes a feeder between feeding point Q1 of antenna conductor 2 (refer to FIG. 2) and a radio communication circuit (not illustrated, e.g., a circuit as a signal source mounted on back surface 1*b* of printed wiring board 1). Via conductor 5 is formed using, for example, copper foil with conductivity, and constitutes a ground line between feeding point Q2 (refer to FIG. 2) of antenna conductor 3 and the above-described radio communication circuit (not illustrated).

Antenna conductor 2 and antenna conductor 3 constitute a dipole antenna, and each have a longitudinal direction extending in −z-direction and +z-direction on a substantially straight line (including a straight line). Antenna conductor 2 and antenna conductor 3 are formed on front surface 1*a* of printed wiring board 1 with ends close to corresponding feeding points Q1, Q2 (hereinafter, referred to as "feeding-side ends"), the ends facing each other at a predetermined interval to minimize cancellation of radio waves radiated from antenna conductors 2, 3.

Antenna conductors 2, 3 have ends opposite to the corresponding feeding-side ends (specifically, the ends away from each other when antenna device 101 is viewed in plan) that are referred to below as "leading-end-side ends" of antenna conductors 2, 3.

Parasitic conductor 8 is disposed parallel to a placement direction (z-direction) of each of antenna conductors 2, 3, and is disposed close to one of side surfaces of each of antenna conductors 2, 3 (on +y-direction side in the example illustrated in FIG. 1) to be electrically separated from antenna conductors 2, 3. A predetermined distance is secured between parasitic conductor 8 and antenna conductor 2 as well as between parasitic conductor 8 and antenna conductor 3 to similarly minimize cancellation of radio waves radiated from each of antenna conductors 2, 3. The predetermined distance is, for example, a distance within a quarter of one wavelength of radio waves in an operation frequency band supported by antenna device 101.

Via conductors 4, 5 are each formed by filling a conductor such as copper foil in a through hole formed in the thickness direction from front surface 1*a* to back surface 1*b* of printed wiring board 1, and are formed directly below feeding points Q1, Q2, respectively, at positions substantially facing each other. Antenna conductor 2 is connected to a feeding terminal of a radio communication circuit (not illustrated, refer to the above description) on back surface 1*b* of printed wiring board 1 with via conductor 4 to function as the feeding antenna conductor. Antenna conductor 3 is connected to ground conductor 9 in printed wiring board 1 and a ground terminal of the radio communication circuit (not illustrated, refer to the above description) with via conductor 5 to function as the non-feeding antenna conductor. Printed wiring board 1 of antenna device 101 may be mounted on a printed wiring board of an electronic device such as a seat monitor.

FIG. 2 illustrates printed wiring board 1 that includes, for example, dielectric substrate 6, artificial magnetic conductor 7, dielectric substrate 11, ground conductor 9, and dielectric substrate 13, being layered in this order from above. Hereinafter, the artificial magnetic conductor will be referred to as "AMC". The layered structure of printed wiring board 1 is an example. Printed wiring board 1 includes AMC 7 and ground conductor 9 that are disposed facing each other and substantially overlapping each other in plan view. This prevents one of AMC 7 and ground conductor 9 from protruding from the other, so that antenna device 101 can be downsized.

Each of dielectric substrates 6, 11, 13 has an insulating property against a DC component, and is made of, for example, glass epoxy.

AMC 7 is an artificial magnetic conductor having perfect magnetic conductor (PMC) characteristics and is formed of a predetermined metal pattern. AMC 7 is provided in its intermediate portion between via conductors 4, 5 facing in z-direction with slit 71 that passes through AMC 7 in the thickness direction and extends to near an end of AMC 7 in the width direction. In the first exemplary embodiment, slit 71 has a shape in which three slits are connected in a central portion in the width direction (refer to FIG. 3). AMC 7 may be provided with a cut-out portion (e.g., a form of an opening) extending from a position away from slit 71 in the longitudinal direction by a predetermined distance to a right (specifically, −z-direction) end of printed wiring board 1 of FIG. 1.

AMC 7 is electrostatically coupled to each of antenna conductors 2, 3 and parasitic conductor 8, and enables the antenna to be thin and to have a high gain. When parasitic conductor 8 is electrostatically coupled to AMC 7 as with antenna conductors 2, 3, capacitance between antenna conductors 2, 3 and AMC 7 can be increased to shift a radio frequency to a lower side. Parasitic conductor 8 is not particularly limited in size, shape, number, and the like. Parasitic conductor 8 is disposed on the same side as antenna conductors 2, 3 in x-direction, and may be disposed on the same surface as AMC 7 instead of the same surface as antenna conductors 2, 3 as long as parasitic conductor 8 is electrostatically coupled to AMC 7.

Via conductor 4 having a cylindrical column shape, for example, is a feeder for supplying electric power to drive antenna conductor 2 as an antenna, and electrically connects antenna conductor 2 formed on front surface 1*a* of printed wiring board 1 to the feeding terminal of the radio communication circuit (not illustrated, refer to the above description). Via conductor 4 is formed substantially coaxially with via conductor insulating holes 17 and 19 formed in AMC 7 and ground conductor 9, respectively, to be electrically insulated from AMC 7 and ground conductor 9. Thus, via conductor 4 has a diameter smaller than a diameter of each of via conductor insulating holes 17, 19.

Via conductor 5 electrically connects antenna conductor 3 to a ground terminal of the radio communication circuit (not illustrated, refer to the above description). Via conductor 5 is electrically connected to each of AMC 7 and ground conductor 9.

Ground conductor 9 is provided with via conductor insulating hole 19 formed by allowing via conductor 4 to pass through and to be electrically insulated from ground conductor 9, and a hole formed by allowing via conductor 5 to pass through and to be electrically connected to ground conductor 9.

Antenna device 101 having the above-described layered structure (refer to FIG. 2) includes antenna conductor 3 on the non-feeding side that is disposed with a longitudinal length from one end of each of AMC 7 and ground conductor 9 (e.g., an end close to antenna conductor 3 on the non-feeding side (+z-direction)) to antenna conductor 3, the longitudinal length being shorter than a longitudinal length from the other end opposite to the one end described above (e.g., an end close to antenna conductor 2 on the feeding side (−z-direction)) to antenna conductor 2. That is, printed wiring board 1 is formed with a length in −z-direction (toward antenna conductor 2) from the center of slit 71 of AMC7 that is not the same as a length in +z-direction (toward antenna conductor 3) therefrom, and is formed with length L1 in +z-direction from the center of slit 71 that is shorter than length L0 in −z-direction by length L2 (=L0−L1).

Thus, antenna device 101 has a shape in which a part (cut-out portion 75) of a leading end portion close to antenna conductor 3 serving as the non-feeding antenna conductor is cut out. In other words, antenna device 101 includes cut-out portion 75 (i.e., a portion where AMC and ground conductor are not formed) acquired by cutting out an approximate half of printed wiring board 1 in +z-direction including antenna conductor 3 on the non-feeding-side to be shorter than an approximate half of printed wiring board 1 in −z-direction including antenna conductor 2 on the feeding side. Here, as illustrated in the following mathematical expression (1), cut-out portion 75 has a size represented by a ratio (cut ratio=L2/L0) of length L2 of cut-out portion 75 to length L0 from the center of slit 71 to a leading end of printed wiring board 1, close to antenna conductor 2 (i.e., a difference from length L1 to a leading end of printed wiring board 1, close to antenna conductor 3).

$$\text{Cut ratio}=L2/L0 \quad (1)$$

In the first exemplary embodiment, the cut ratio is 51%, for example. For example, when the printed wiring board before cutting has a length (a sum of lengths of printed wiring board 1 and cut-out portion 75) of 83 mm, the cut-out portion has a length of about 21 mm.

Examples of the cut ratio in PTL 1 include 7.5%, 15.1%, 22.6%, 30.2%, 37.7%, and 45.3%. When the cut ratio is, for example, 52.8% or 60.4%, as disclosed in PTL 1, a range with a voltage standing wave ratio (VSWR) in a band of from 2.4 GHz to 2.5 GHz (e.g., one form of a fundamental wave band) less than or equal to 3 may be narrowed (narrowed band), or unnecessary resonance may be caused to reduce the VSWR to less than or equal to 3 at 2.7 GHz. This kind of unnecessary resonance may be caused by presence of a conductor (e.g., a metal) that surrounds the antenna device (e.g., a housing of a seat monitor).

As described above, when cut-out portion 75 without AMC 7 and ground conductor 9 is provided to downsize antenna device 101, antenna device 101 can transmit and receive a radio signal in the fundamental wave band, and can prevent radiation of a radio signal in a second harmonic band. However, as disclosed in PTL 1, the cut ratio exceeding 50% may cause a usable band in the fundamental wave band to be narrowed, or may cause unnecessary resonance to be likely to occur.

In contrast, the first exemplary embodiment additionally includes at least one via conductor (e.g., via conductors 31 to 38 described later, each of which may be referred to as an "end via conductor") to cause a usable range in the fundamental wave band to be a wide band and to stabilize gain by preventing decrease in gain due to occurrence of unnecessary resonance, even when the cut ratio exceeds 50%. At least one of the end via conductors is added in a range from antenna conductor 3 on the non-feeding side of printed wiring board 1 to an end of printed wiring board 1, close to cut-out portion 75. Here, a structure with eight end via conductors added is illustrated, for example.

Eight via conductors 31 to 38 are disposed in line at equal intervals in the longitudinal direction (z-direction) of printed wiring board 1. Eight via conductors 31 to 38 each pass through AMC 7, dielectric substrates 11 and 13, and ground conductor 9, in printed wiring board 1 on which antenna conductor 3 on the non-feeding side is disposed, to electrically connect AMC 7 and ground conductor 9. Eight via conductors 31 to 38 are each formed from a leading-end side of ground conductor 9 toward a position substantially facing a leading-end-side end opposite to a feeding-side end of antenna conductor 3. That is, eight via conductors 31 to 38 are each formed without extending toward a position facing antenna conductor 3 in x-direction. This enables the eight via conductors to be disposed on a cut-out portion side of printed wiring board 1, so that characteristics of the antenna device acquired by cutting AMC 7 and ground conductor 9 can be improved.

Additionally, distance s between adjacent via conductors in eight via conductors 31 to 38 is set shorter than one-eighth of wavelength λ of a radio wave transmitted and received.

Wavelength λ of a radio wave is acquired by the mathematical expression (2).

$$\lambda=C/f \quad (2)$$

where C is a speed of a radio wave (3×1011 mm/s), and f is a frequency of the radio wave. For example, when the radio wave has a frequency f of 2.5 GHz, the radio wave has a wavelength λ of 15 mm. Thus, distance s between via conductors is less than 15 mm/8, or about 1.9 mm.

The first exemplary embodiment shows an example in which eight via conductors 31 to 38 are provided using a printed wiring board having a length of 83 mm before cutting and a cut ratio of 51%, and a radio wave frequency of 2.5 GHz.

As described above, antenna device 101 according to the first exemplary embodiment enables not only downsizing due to cut-out portion 75, but also apparent increase of a region where AMC 7 and ground conductor 9 are electrically connected by adding via conductors 31 to 38. This enables preventing occurrence of unnecessary resonance due to antenna device 101 having an asymmetric structure caused by cutting AMC 7 and ground conductor 9.

The plurality of via conductors to be added are not limited to being disposed in line at equal intervals in the longitudinal direction on a surface of printed wiring board 1, and may be arbitrarily disposed. For example, the plurality of via conductors may be disposed obliquely with respect to the longitudinal direction of the printed wiring board. The plurality of via conductors also may be disposed not only linearly in line (linear placement) but also forming a predetermined surface (plane placement). However, when the plurality of via conductors is disposed in line in a direction perpendicular to the antenna conductor, i.e., in the width direction (y-direction) of the printed wiring board, effect of the via conductors is hardly obtained.

Figure 3:
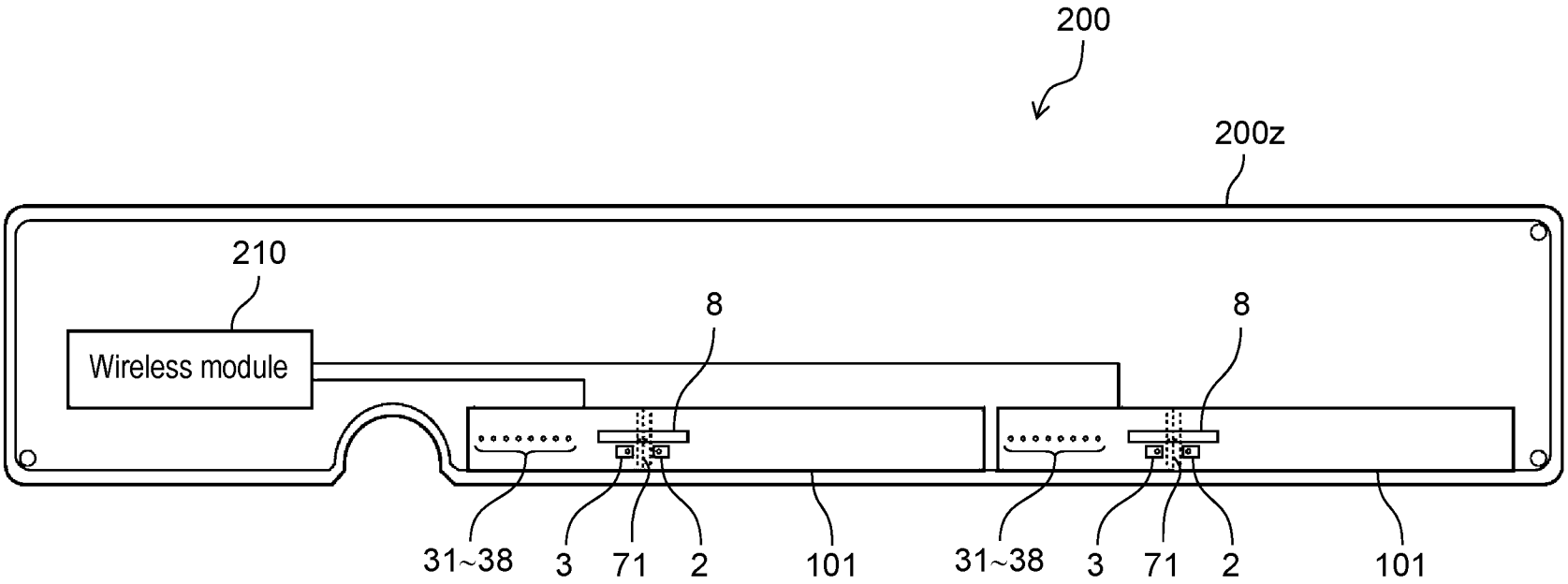
FIG. 3 is a plan perspective view, as viewed from above, of the inside of a seat monitor mounted with the antenna device according to the first exemplary embodiment.

FIG. 3 is a plan perspective view, as viewed from above, of the inside of seat monitor 200 mounted with antenna device 101 according to the first exemplary embodiment. Seat monitor 200 is installed on the back of a backrest of an economy class seat mounted in an aircraft. FIG. 3 illustrates the inside of seat monitor 200 in a state where a front panel, which is a part of housing 200*z* of seat monitor 200, is removed. Housing 200*z* of seat monitor 200 is provided inside with wireless module 210 and one set of antenna devices 101.

Antenna device 101 in FIG. 3 is drawn in a perspective view. That is, when antenna device 101 is viewed in plan view, antenna conductors 2, 3 and parasitic conductor 8 are located in the uppermost layer, and are thus drawn by solid lines. Slits 71 and via conductors 31 to 38 formed in AMC 7 are located in an intermediate layer, and are thus drawn by broken lines.

Wireless module 210 supplies power to antenna device 101 (a radio communication circuit disposed on back surface 1*b* of printed wiring board 1) and performs signal processing of radio waves transmitted and received by antenna device 101. Wireless module 210 and the radio communication circuit include electronic components such as a filter, a switch, a transmitting and receiving transformer, and a signal processing integrated circuit (IC). In the first exemplary embodiment, a module for Bluetooth (registered trademark) is used as the wireless module. The radio communication circuit may be provided inside wireless module 210.

One set (here, two) of antenna devices 101 each functions as an antenna element that radiates a radio wave of 2.4 GHz to 2.5 GHz from the front of seat monitor 200 toward the front of a rear seat. Two antenna devices 101 are disposed side by side (in a horizontal direction) parallel to the front of the rear seat. That is, disposing two antenna devices 101 adjacent to each other in z-direction enables an orientation of a radio wave projected from each of antenna devices 101 to be directed toward the rear seat. This enhances directivity of a radio wave to be projected on the rear seat. The one set of antenna devices is not limited to two antenna devices and may be three or more antenna devices.

Figure 4:
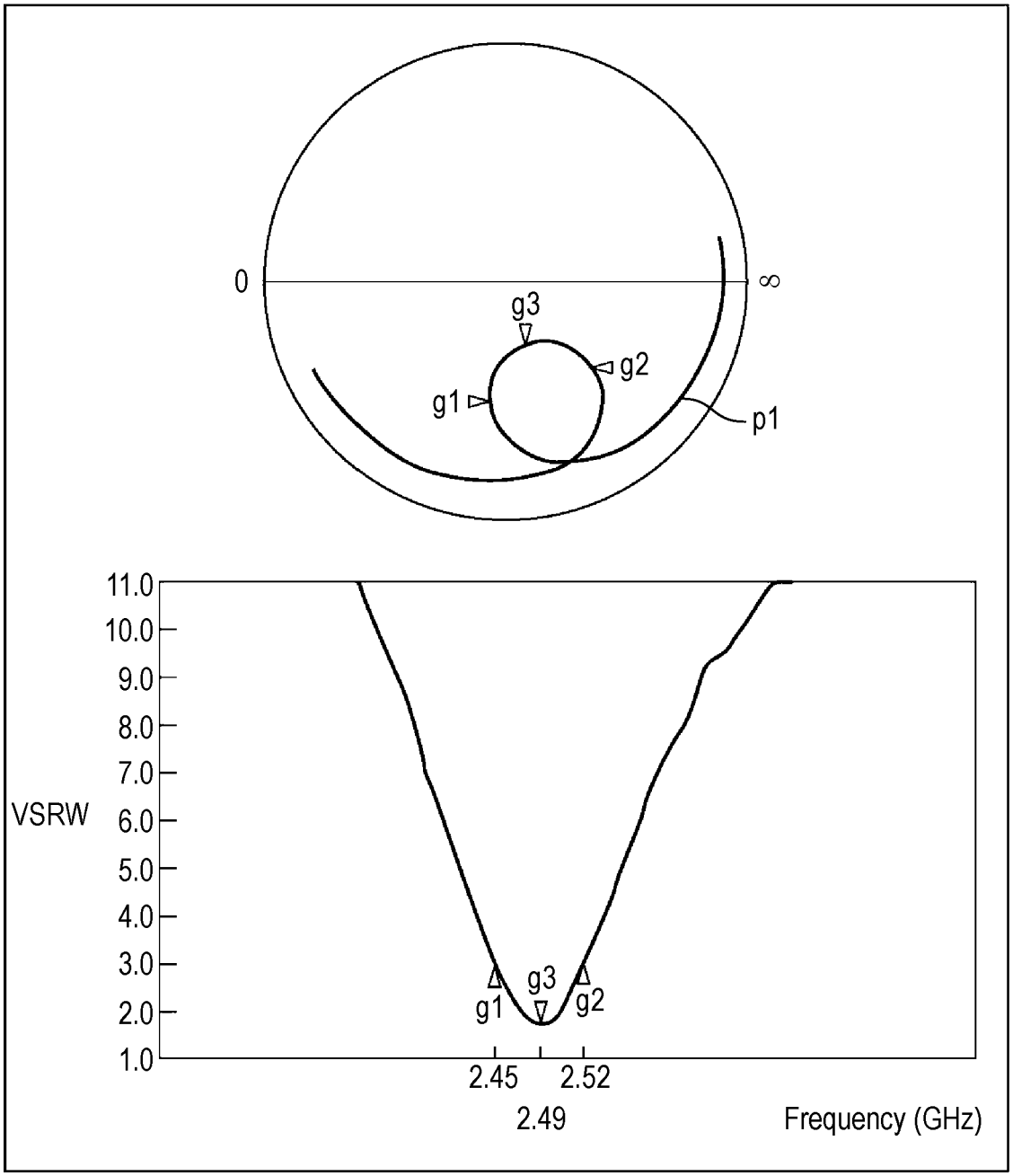
FIG. 4 is a diagram illustrating an example of frequency characteristics and directivity characteristics of a voltage standing wave ratio in the antenna device according to the first exemplary embodiment.

FIG. 4 is a diagram illustrating an example of frequency characteristics and directivity characteristics of a voltage standing wave ratio (VSWR) in antenna device 101 according to the first exemplary embodiment. In the graph illustrating VSWR characteristics (the lower diagram in FIG. 4), the vertical axis represents the VSWR and the horizontal axis represents a frequency. The VSWR indicates a degree of impedance matching (degree of reflection) using a ratio of a traveling wave and a reflected wave in a standing wave, and is particularly calculated as a ratio of maximum amplitude and minimum amplitude of a voltage of a radio wave that is the standing wave. As the VSWR approaches a value of 1, reflected waves decrease to cause a better impedance matching state. Thus, as the VSWR approaches the value of 1, radio wave transmission efficiency increases. A wide band means that a range where the VSWR is less than 3 is wide in the fundamental wave band (the band of 2.4 GHz to 2.5 GHz).

The VSWR characteristics of antenna device 101 have point g3 at a frequency of 2.49 GHz and a VSWR of 1.8, which is a lower limit (peak). Point g1 indicates a frequency of 2.45 GHz and a VSWR of 3.0. Point g2 indicates a frequency of 2.52 GHz and the VSWR of 3.0. As described above, the VSWR in the fundamental wave band is almost less than or equal to 3. This demonstrates that antenna device 101 can transmit and receive a radio signal in the fundamental wave band with a predetermined loss or less. A band other than the fundamental wave band has a high VSWR that is not less than or equal to 3. Thus, antenna device 101 does not transmit and receive an unnecessary radio wave, and thus can sufficiently prevent radiation of a radio signal due to unnecessary resonance and of a radio signal in the second harmonic band.

The Smith chart illustrating directivity characteristics (upper part of FIG. 4) shows a degree of impedance matching. The horizontal axis of the Smith chart represents real parts of complex reflection coefficients, and the vertical axis represents imaginary parts. The Smith chart has the center that is a point with a maximum degree of impedance matching (i.e., a maximum reflection coefficient of 1). Antenna device 101 according to the first exemplary embodiment has radiation pattern p1 of a radio wave, in which a degree of impedance matching approaches the center of the Smith chart along a circle in the fundamental wave band. In this case, point g3 comes closest to the center of the Smith chart. Thus, antenna device 101 has radiation pattern p1 of a radio wave, in which degrees of impedance matching are gathered near the center of the directivity characteristic diagram in the fundamental wave band, so that a wide band can be achieved.

Comparative Example

Figure 5:
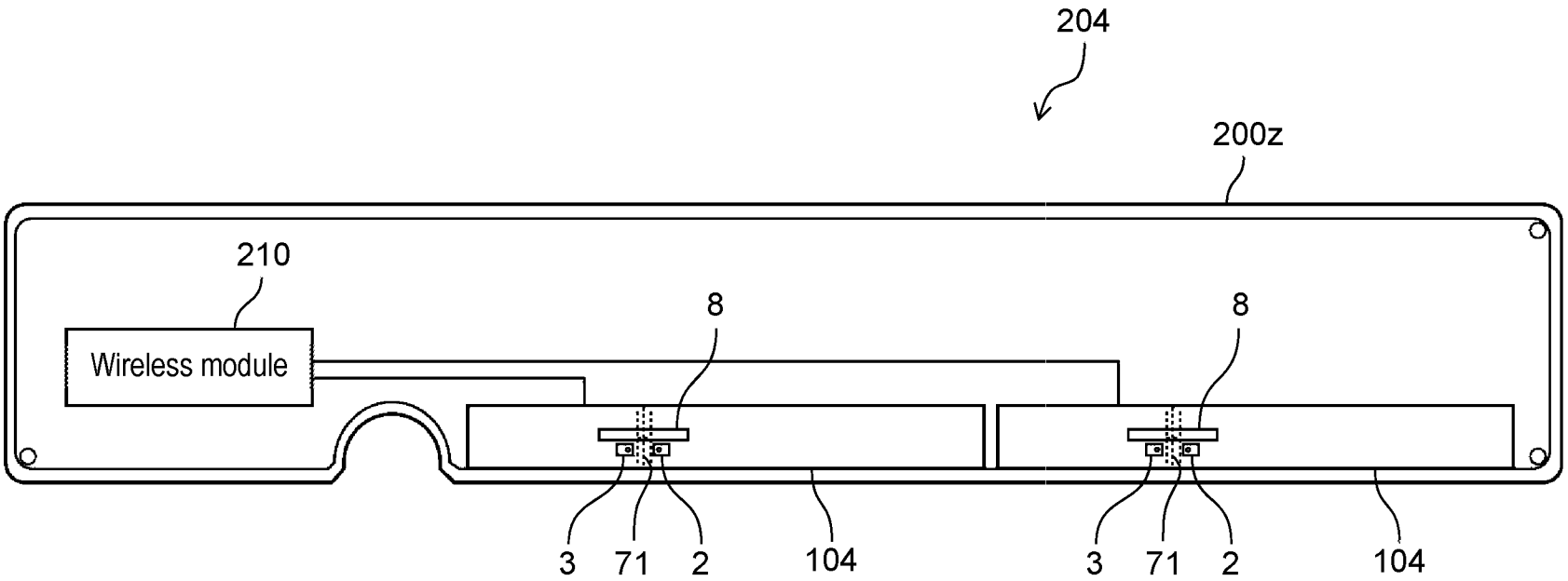
FIG. 5 is a plan perspective view, as viewed from above, of the inside of a seat monitor mounted with an antenna device according to a comparative example.

FIG. 5 is a plan perspective view, as viewed from above, of the inside of seat monitor 204 mounted with antenna device 104 according to a comparative example. Seat monitor 204 excluding antenna device 104 has a configuration identical to that of the first exemplary embodiment, and thus duplicated description of the same contents is eliminated. Further, antenna device 104 of the comparative example has the same configuration as antenna device 101 according to the first exemplary embodiment except that eight via conductors 31 to 38 are eliminated, so that duplicated description of the same contents is eliminated.

Figure 6:
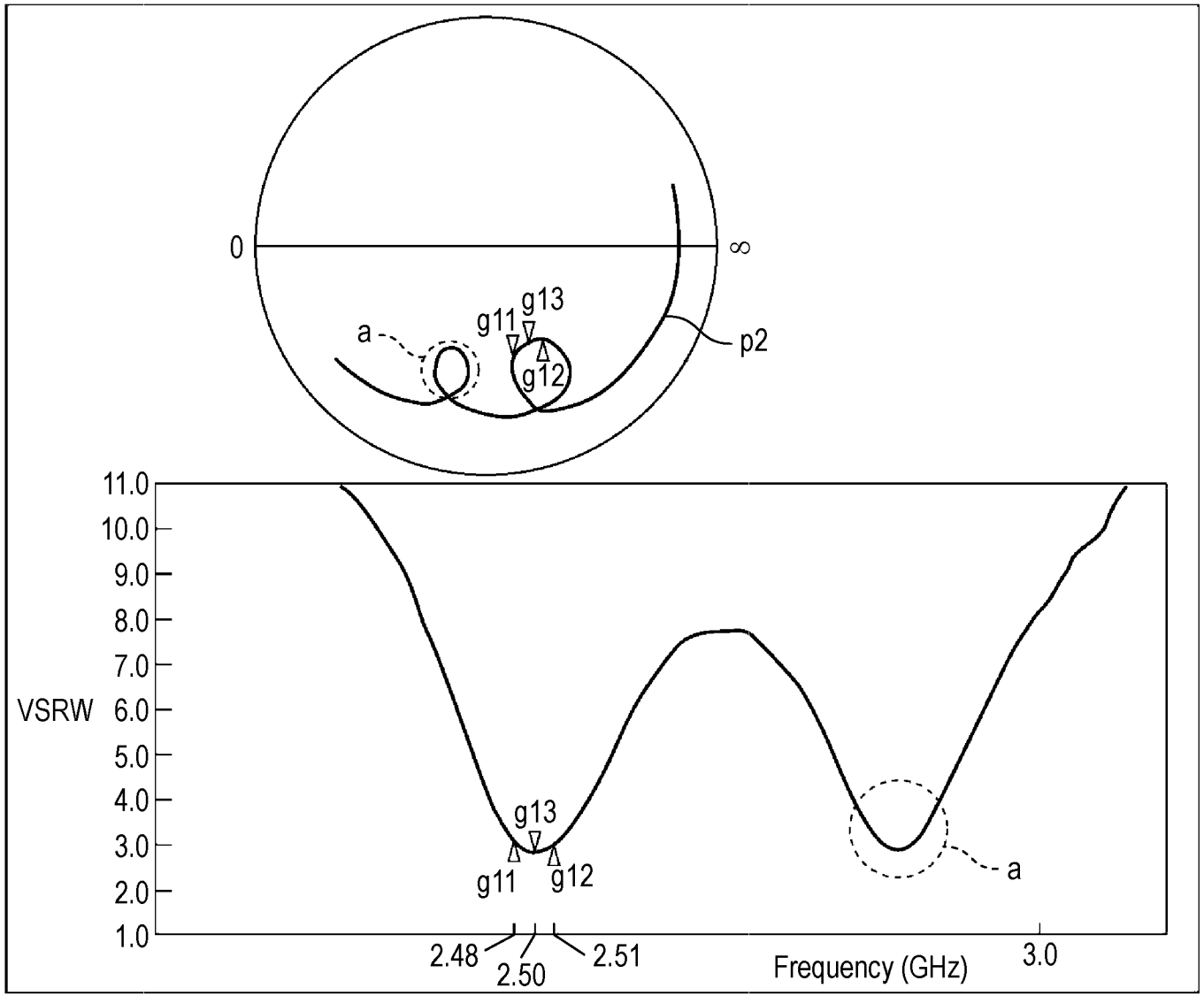
FIG. 6 is a diagram illustrating an example of frequency characteristics and directivity characteristics of a voltage standing wave ratio in the antenna device according to the comparative example.

FIG. 6 is a diagram illustrating an example of frequency characteristics and directivity characteristics of a voltage standing wave ratio (VSWR) in antenna device 104 according to a comparative example. VSWR characteristics (lower part of FIG. 6) of antenna device 104 according to the comparative example have point g13 at a frequency of 2.5 GHz and a VSWR of 2.8, which is a lower limit (peak). Point g11 indicates a frequency of 2.48 GHz and a VSWR of 3.0. Point g12 indicates a frequency of 2.51 GHz and the VSWR of 3.0. As described above, antenna device 104 according to the comparative example has a narrower range in which the VSWR in the fundamental wave band is less than or equal to 3 than the antenna device 101 according to the first exemplary embodiment. This demonstrates that antenna device 104 has a narrow range in which a radio signal can be transmitted and received in the fundamental wave band with a predetermined loss or less, i.e., a narrow band. Even in a band other than the fundamental wave band, which is surrounded by broken line a in FIG. 6, the VSWR has a value less than or equal to 3. That is, antenna device 104 transmits and receives an unnecessary radio wave, and has unstable frequency characteristics of a radio wave. This reduces a gain of the antenna.

Antenna device 104 according to the comparative example has radiation pattern p2 (upper part of FIG. 6) of a radio wave, in which a degree of impedance matching approaches the center of a directivity characteristic diagram along a circle smaller than that of radiation pattern p1 in the fundamental wave band, and besides this, the degree of impedance matching approaches the center of the directivity characteristic diagram along a smaller circle even in a band exceeding the fundamental wave band, surrounded by broken line a in FIG. 6.

As described above, antenna device 104 according to the comparative example has a narrow range in which the VSWR is less than or equal to 3 in the fundamental wave band, so that a wide band cannot be achieved. Antenna device 104 also leaks and radiates an unnecessary radio wave.

Antenna device 101 according to the first exemplary embodiment enables downsizing of the antenna device by providing the cut-out portion 75 in the printed wiring board 1 to reduce a longitudinal length of antenna device 101. Even at a cut ratio exceeding 50%, adding via conductors 31 to 38 enables preventing a usable band in the fundamental wave band from narrowing, an unnecessary resonance from occurring, and radiation of an unnecessary radio wave including the second harmonic band. This enables antenna device 101 to be stabilized in frequency characteristics and to be downsized. Antenna device 101 also can transmit and receive a radio signal in the fundamental wave band with a predetermined loss or less, and thus can achieve a wide band. This enables antenna device 101 to sufficiently block radiation of an unnecessary radio wave to improve an antenna gain.

As described above, antenna device 101 according to the first exemplary embodiment includes the set of antenna conductors 2, 3 (specifically, antenna conductor 2 as the feeding antenna conductor and antenna conductor 3 as the non-feeding antenna conductor), ground conductor 9, and AMC 7 (artificial magnetic conductor) that is layered between antenna conductors 2, 3 and ground conductor 9 and that is disposed away from each of antenna conductors 2, 3 and ground conductor 9. Antenna conductor 3 is disposed with a longitudinal length from one end of each of AMC 7 and ground conductor 9 (e.g., an end close to antenna conductor 3 on the non-feeding side (+z-direction)) to antenna conductor 3, the longitudinal length being shorter than a longitudinal length from the other end opposite to the one end described above (e.g., an end close to antenna conductor 2 on the feeding side (−z-direction)) to antenna conductor 2. Eight via conductors 31 to 38 (an example of at least one via conductor) that electrically connects ground conductor 9 and AMC 7 are provided on a side close to one end (refer to the above description) of ground conductor 9 from a position of ground conductor 9, substantially facing antenna conductor 3.

This allows not only antenna device 101 to have cut-out portion 75 to be downsized as compared with a structure without cut-out portion 75, but also a region for electrically connecting AMC7 and ground conductor 9 to be apparently increased by adding via conductors 31 to 38. Thus, antenna device 101 can prevent occurrence of unnecessary resonance due to the asymmetric structure of antenna device 101 caused by cutting AMC 7 and ground conductor 9. In other words, antenna device 101 can achieve both miniaturization as an antenna device and stabilization of frequency characteristics of a fundamental wave at a desired operation frequency.

Eight via conductors 31 to 38 are each formed from a leading-end side of ground conductor 9 toward a position substantially facing a leading-end-side end opposite to a feeding-side end of antenna conductor 3. This enables the plurality of via conductors 31 to 38 to be disposed close to cut-out portion 75 of antenna device 101, so that characteristics of antenna device 101 caused by cutting out a part of AMC 7 and ground conductor 9 can be improved.

Adjacent via conductors in eight via conductors 31 to 38 have a distance less than one-eighth of one wavelength corresponding to the operation frequency of antenna device 101. This enables antenna device 101 to have the plurality of via conductors that is accurately disposed in accordance with a frequency of a radio wave to be radiated, so that a radio wave with a desired frequency can be radiated.

Antenna device 101 further includes parasitic conductor 8 provided on printed wiring board 1 on which antenna conductors 2, 3 are disposed. This enables parasitic conductor 8 to increase capacitance between antenna conductors 2, 3 and AMC 7 to shift the radio frequency to a lower side. Thus, even when antenna device 101 is downsized, antenna device 101 can transmit and receive a radio wave having a radio frequency in the fundamental wave band (2.4 GHz band).

Ground conductor 9 and AMC 7 are disposed facing each other and substantially overlapping each other in plan view. This prevents one of AMC 7 and ground conductor 9 from protruding from the other, so that antenna device 101 can be downsized.

Eight via conductors 31 to 38 are formed in line at equal intervals in the longitudinal direction of printed wiring board 1 on which AMC 7 and ground conductor 9 are disposed. This enables the number of via conductors and a distance between corresponding via conductors to be accurately calculated based on the radio frequency.

Antenna conductors 2, 3 constitute a dipole antenna. Slit 71 is formed in AMC 7 at a position substantially facing a position between antenna conductor 2 on the feeding side and antenna conductor 3 on the non-feeding side. This enables antenna device 101 to increase a gain of the dipole antenna downsized.

Antenna device 101 may include a plurality of antenna elements each having antenna conductors 2, 3, ground conductor 9, and AMC 7 (refer to FIG. 3). In this case, each of the plurality of antenna elements is disposed side by side and radiates a radio wave having a predetermined directivity from the corresponding one of the plurality of antenna elements. This enables increase in directivity of a radio wave to be transmitted and received from an electronic device such as a seat monitor mounted with antenna device 101.

Although various exemplary embodiments have been described above with reference to the drawings, it is needless to say that the present disclosure is not limited to such examples. It is obvious to those skilled in the art that various modification examples, modification examples, substitution examples, addition examples, deletion examples, and equivalent examples can be conceived within the scope of claims, and thus it is obviously understood that those examples belong to the technical scope of the present disclosure. Additionally, each component in the various exemplary embodiments described above may be arbitrarily combined without departing from the spirit of the disclosure.

For example, the first exemplary embodiment described above shows a two-element array in which antenna device 101 includes two printed wiring boards disposed in the longitudinal direction in the housing of the seat monitor, for example, to increase directivity of a radio wave in a direction toward the front of the rear seat. However, when the directivity is not particularly required to be increased, antenna device 101 may be, for example, one element in which one printed wiring board is disposed in the housing of the seat monitor. Antenna device 101 is not limited to the two-element array, and may be a multi-element array in which three or more printed wiring boards are disposed in the longitudinal direction in the housing of the seat monitor.

The first exemplary embodiment described above shows an example in which antenna device 101 is mounted in the seat monitor installed in the aircraft. However, the present disclosure is not limited to a seat monitor, and antenna device 101 may be mounted in many internet of things (IoT) devices such as a cordless phone master unit or a slave unit, an electronic shelf label (e.g., a card-type electronic device that is attached to a display shelf of a retail store, and displays a selling price of a product), a smart speaker, an in-vehicle device, a microwave oven, and a refrigerator.

The first exemplary embodiment described above shows that antenna device 101 is an example of an antenna device that can operate supporting Bluetooth (registered trademark) with a main operation frequency in the 2.4 GHz band (e.g., 2.4 GHz to 2.5 GHz), for example. However, antenna device 101 may be used as an antenna device for Wifi (registered trademark) with the same frequency band (e.g., 2.4 GHz) as the operation frequency band of Bluetooth (registered trademark), or may be used as an antenna device for another frequency band.

Although antenna device 101 according to the first exemplary embodiment described above is described as an example of an antenna device capable of both transmitting and receiving a radio wave, the present disclosure may be applied to, for example, an antenna device designed for transmission or reception.

The present disclosure is useful as an antenna device that achieves both miniaturization as an antenna device and stabilization of frequency characteristics of a fundamental wave at a desired operation frequency.

What is claimed is:

1. An antenna device comprising:

a ground conductor having one end and another end opposite to the one end in a longitudinal direction;

a feeding antenna conductor disposed close to the other end;

a non-feeding antenna conductor disposed close to the one end;

an artificial magnetic conductor that is layered between the feeding antenna conductor as well as the non-feeding antenna conductor, and the ground conductor, and that is disposed away from each of the feeding antenna conductor, the non-feeding antenna conductor, and the ground conductor; and at least one via conductor that is disposed between the one end of the ground conductor and the non-feeding antenna conductor in the longitudinal direction, and that electrically connects the ground conductor and the artificial magnetic conductor, wherein in the longitudinal direction, a length from the one end of the ground conductor to the non-feeding antenna conductor is shorter than a length from the other end of the ground conductor to the feeding antenna conductor, the at least one via conductor includes a plurality of via conductors, and adjacent via conductors in the plurality of via conductors have a distance less than one-eighth of one wavelength corresponding to an operation frequency of the antenna device.

2. The antenna device according to claim 1, further comprising:

a board on which the feeding antenna conductor and the non-feeding antenna conductor are disposed; and a parasitic conductor provided on the board.

3. The antenna device according to claim 1, wherein the ground conductor and the artificial magnetic conductor are disposed facing each other and substantially overlapping each other in plan view.

4. The antenna device according to claim 1, wherein the plurality of via conductors is formed in line at substantially equal intervals in the longitudinal direction.

5. The antenna device according to claim 1, wherein the feeding antenna conductor and the non-feeding antenna conductor constitute a dipole antenna, and the artificial magnetic conductor has a slit at a position substantially facing a position between the feeding antenna conductor and the non-feeding antenna conductor.

6. One set of antenna devices comprising:

a plurality of antenna elements disposed side by side, the plurality of antenna elements each being the antenna device according to claim 1, wherein the plurality of antenna elements each radiates a radio wave having a predetermined directivity.

* * * * *